US005208127A

United States Patent [19]

Terrell et al.

[11] Patent Number: 5,208,127

[45] Date of Patent: May 4, 1993

[54] PHOTOCONDUCTIVE RECORDING MATERIAL WITH SPECIAL OUTERMOST LAYER

[75] Inventors: David R. Terrell, Lint; Stefaan K. De Meutter, Zandhoven, both of Belgium; Peter Horlacher, Senden, Fed. Rep. of Germany; Volker Serini, Krefeld, Fed. Rep. of Germany; Ulrich Grigo, Kempen, Fed. Rep. of Germany

[73] Assignee: Agfa-Gevaert, N.V., Mortsel, Belgium

[21] Appl. No.: 611,087

[22] Filed: Nov. 9, 1990

[30] Foreign Application Priority Data

Nov. 13, 1989 [EP] European Pat. Off. ..... 89202865.5

[51] Int. Cl.[5] ..... G03G 5/14

[52] U.S. Cl. ..... 430/59; 430/58; 430/66; 430/96

[58] Field of Search ..... 430/59, 66, 58, 96

[56] References Cited

U.S. PATENT DOCUMENTS 4,923,775 5/1990 Schank ..... 430/59

4,962,008 10/1990 Kinura et al. ..... 430/66

*Primary Examiner*—Marion E. McCamish

*Assistant Examiner*—S. Rosasco

*Attorney, Agent, or Firm*—Breiner & Breiner

[57] ABSTRACT

Photoconductive recording material which incorporates in an outermost layer a siloxane-copolymer including at least one polysiloxane block that is copolymerized with aromatic ester units or with aromatic carbonate units and aromatic ester units, wherein the polysiloxane block(s) consist(s) of 5 to 200 chemically bonded diorgano siloxy units in which the organic substituents are selected from the group consisting of an alkyl, an aralkyl, an alkaryl and an aryl group and said block(s) is (are) present in an amount by weight in the range 0.3% to 80% with respect to the total weight of said copolymer.

13 Claims, No Drawings

PHOTOCONDUCTIVE RECORDING MATERIAL WITH SPECIAL OUTERMOST LAYER

The present invention relates to photosensitive recording materials suitable for use in electrophotography.

In electrophotography photoconductive materials are used to form a latent electrostatic charge image that is developable with finely divided colouring material, called toner.

The developed image can then be permanently affixed to the photoconductive recording material, e.g. a photoconductive zinc oxide-hinder layer, or transferred from the photoconductor layer, e.g. a selenium or selenium alloy layer, onto a receptor material, e.g. plain paper and fixed thereon. In electrophotographic copying and printing systems with toner transfer to a receptor material the photoconductive recording material is reusable. In order to permit rapid multiple printing or copying, a photoconductor layer has to be used that rapidly looses its charge on photo-exposure and also rapidly regains its insulating state after the exposure to receive again a sufficiently high electrostatic charge for a next image formation. The failure of a material to return completely to its relatively insulating state prior to succeeding charging/imaging steps is commonly known in the art as "fatigue".

The fatigue phenomenon has been used as a guide in the selection cf commercially useful photoconductive materials, since the fatigue of the photoconductive layer limits the copying rates achievable.

A further important property which determines the suitability of a particular photoconductive material for electrophotographic copying is its photosensitivity which must be sufficiently high for use in copying apparatuses operating with the fairly low intensity light reflected from the original. Commercial usefulness also requires that the photoconductive layer has a spectral sensitivity that matches the spectral intensity distribution of the light source e.g. a laser or a lamp. This enables, in the case of a white light source, all the colours to be reproduced in balance.

Known photoconductive recording materials exist in different configurations with one or more "active" layers coated on a conducting substrate and include optionally a protective layer. By "active" layer is meant a layer that plays a role in the formation of the electrostatic charge image. Such layer may be a layer responsible for charge carrier generation, charge carrier transport or both. Such layers may have a homogeneous structure of heterogeneous structure.

Examples of active layers in said photoconductive recording material having a homogeneous structure are layers made of vacuum-deposited photoconductive selenium, doped silicon, selenium alloys and homogeneous photoconducting polymer coatings, e.g. of poly(-vinylcarbazole) or polymeric binder(s) molecularly doped with a charge carrier transport compound such as particular hydrazones, amines and heteroaromatic compounds sensitized by a dissolved dye, so that in said layers both charge carrier generation and charge carrier transport takes place.

Examples of active layers in said photoconductive recording material having a heterogeneous structure are layers of one or more photosensitive organic or inorganic charge generating pigment particles dispersed in a polymer binder or polymer binder mixture in the presence optionally of (a) molecularly dispersed charge transport compound(s), so that the recording layer may exhibit only charge carrier generation properties or both charge carrier generation and charge transport properties.

According to an embodiment that may offer photoconductive recording materials with particularly low fatigue a charge generating and charge transporting layer are combined in contiguous relationship. Layers which serve only for charge transport of charge generated in an adjacent charge generating layer are e.g. plasma-deposited inorganic layers, photoconducting polymer layers, e.g. on the basis of poly(N-vinylcarbazole) or layers made of a low molecular weight organic compounds of the group of hydrazones, amines and heteroaromatic compounds molecularly distributed in a polymer binder or hinder mixture.

Useful organic charge carrier generating pigments belong to one of the following classes :

a) perylimides, e.g. C.I. 71 130 (C.I.=Colour Index) described in DBP 2 237 539;
b) polynuclear quinones, e.g. anthanthrones such as C.I. 59 300 described in DBP 2 237 678;
c) quinacridones, e.g. C.I. 46 500 described in DPB 2 237 679;
d) naphthalene 1,4,5,8-tetracarboxylic acid derived pigments including the perinones, e.g. Orange GR, C.I. 71 105 described in DBP 2 239 923;
e) phthalocyanines and naphthalocyanines, e.g. $H_2$-phthalocyanine in X-crystal form (X-$H_2$Pc) described in U.S. Pat. No. 3,357,989, metal phthalocyanines, e.g. CuPc C.I. 74 160 described in DBP 2 239 924, indium phthalocyanine described in U.S. Pat. No. 4,713,312; and naphthalocyanines having siloxy groups bonded to the central metal silicon described in published EP-A 243,205;
f) indigo- and thioindigo dyes, e.g. Pigment Red 88 C.I. 73 312 described in DBP 2 237 689;
g) benzothioxanthene derivatives as described e.g. in Deutsches Auslequngsschrift (DAS) 2 355 075;
h) perylene 3,4,9,10-tetracarboxylic acid derlved pigments including condensation products with o-diamines as described e.g. in DAS 2 314 051;
i) polyazo-pigments including bisazo-, trisazo- and tetrakisazo-pigments, e.g. Chlordiane Blue C.I. 21 180 described in DAS 2 635 887, and bisazo-pigments described in Deutsches Offenlegungsschrlft (DOS) 2 919 791, DOS 3 026 653 and DOS 3 032 117;
j) squarylium dyes as described e.g. in DAS 2 401 220;
k) polymethine dyes;
l) dyes containing quinazoline groups, e.g. as described in GB-P 1,416,602 according to the following general formula :

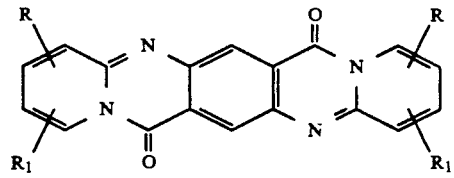

in which R and $R_1$ are either identical or different and denote hydrogen, $C_1$–$C_4$ alkyl, alkoxy, halogen, nitro or hydroxyl or together denote a fused aromatic ring system;

m) triarylmethane dyes; and n) dyes containing, 1,5 diamino-anthraquinone groups.

Organic charge carrier transporting substances may he either polymeric or non-polymeric materials.

Examples of preferred polymeric positive hole charge carrier transporting substances are poly(N-vinylcarbazole), N-vinylcarbazole copolymers, polyvinyl anthracene and the condensation products of an aldehyde with two or more 1,2-dlhydroquinoline molecules as described in non-published EP application No. 89 200 707.1.

Preferred non-polymeric materials for positive charge transport are :

a) hydrazones e.g. a p-diethylaminobenzaldehyde diphenyl hydrazone as described in U.S. Pat. No. 4,150,987; and other hydrazones described in U.S. Pat. No. 4,423,129; U.S. Pat. No. 4,278,747 and U.S. Pat. No. 4,365,014;
b) aromatic amines e.g. N,N'-diphenyl, N,N-bis-m-tolyl benzidine as described in U.S. Pat. No. 4,265,990, tris(p-tolyl)amine as described in U.S. Pat. No. 3,180,730 and 1,3,5-tris(aminophenyl)benzenes as described in non-published EP application 88 20 1332.9;
c) heteroaromatic compounds e.g. N-(p-aminophenyl) carbazoles as described in U.S. Pat. No. 3,912,509 and dihydroquinoline compounds as described in U.S. Pat. No. 3,832,171 and U.S. Pat. No. 3,830,647;
d) triphenylmethane derivatives as described for example in U.S. Pat. No. 4,265,990;
e) pyrazoline derivatives as described for example in U.S. Pat. No. 3,837,851;
f) stilbene derivatives as described for example in Japanese Laid Open Patent Application (JL-OP) 198,043/83;

and for negative charge transport are :

a) nitrated fluorenones such as 2,4,7-trinitrofluorenone and 2,4,5,7-tetranitrofluorenone;
b) nitrated dicyano-methylene-fluorene compounds such as 2,4,7-trinitro-1,1-dicyanomethylene fluorene;
c) 4H-thiopyran-1,1-dioxide as described in EP 157,492;
d) sulfur incorporated dicyanofluorene carboxylate derivatives as described in U.S. Pat. No. 4,546,059;

Preferred negative charge, i.e. electron transporting compounds have the following formula:

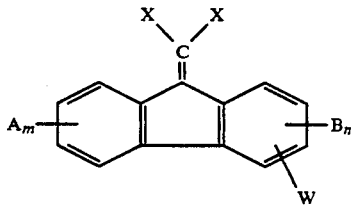

wherein X is cyano or alkoxycarbonyl, A and B are electron withdrawing groups, m is a number of from 0 to 2, n is the number 0 or 1, and W is an electron withdrawing group selected from the group consisting of acyl, alkoxycarbonyl, alkylamino carbonyl and derivatives thereof as disclosed e.g. in U.S. Pat. No. 4,562,132.

In an electrophotographic copying or printing process the recording layers are subject to mechanical abrasion which takes place e.g. in magnetic brush development, transfer of toner to paper or other substrates and mechanical cleaning wherein untransferred toner is removed with a scraper or a brush.

The abrasion resistance and surface behaviour of the photoconductive recording material are determined by the composition of the outermost layer. This may be an active layer in the sense as defined above or a protective layer. Binderless polymeric charge carrier transport layers are brittle and hence exhibit poor abrasion resistance as is also the case also with binderless inorganic and organic photoconductor layers for which a protective layer is required.

Various electronically inactive binder resins have been proposed for use in photoconductive recording layer materials.

Polycarbonates by virtue of their being excellent solvents for charge carrier transport molecules and their electronic inactivity are widely used as binder resins for photoconductors.

In U.S. Pat. No. 2,999,750 has been disclosed the use of high molecular weight polycarbonates based on 4,4' di-monohydroxy-aryl-alkanes having the following general formula:

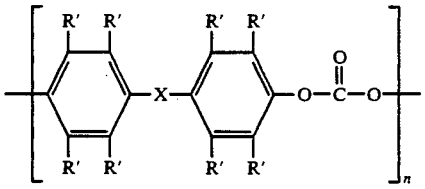

wherein each of R' (same or different) represents a hydrogen atom, a monovalent, branched or unbranched aliphatic hydrocarbon radical with up to five carbon atoms, a monovalent cyclo-aliphatic radical or an aromatic hydrocarbon radical, and

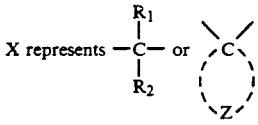

wherein each of $R_1$ and $R_2$ is a hydrogen atom, branched or unbranched monovalent hydrocarbon radical with not more than 10 carbon atoms, monovalent cyclo-aliphatic radical, monovalent araliphatic radical, phenyl or furyl radical, Z represents the atoms necessary to form with the associated carbon atom a cycloaliphatic ring, and n is a whole number greater than 20, preferably greater than 50.

In U.S. Pat. No. 4,637,971 has been disclosed the utilization of polycarbonates with compositions of formula (A) or (B):

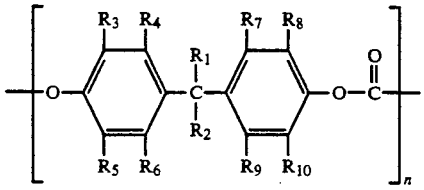

(A)

-continued (B)

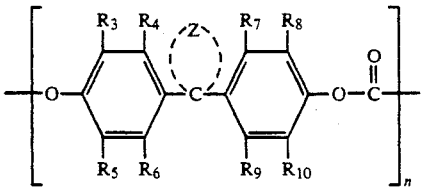

wherein $R_1$ and $R_2$ are independently hydrogen, substituted or unsubstituted aliphatic, or a substituted or unsubstituted hydrocarbon ring, provided that at least one of $R_1$ and $R_2$ has at least 3 carbon atoms, Z represents a group of atoms necessary to constitute a substituted or unsubstituted carbon ring or a substituted or unsubstituted heterocyclic ring, $R_3$ to $R_{10}$ in formulas (A) and (B) are independently hydrogen, halogen, substituted or unsubstituted aliphatic, or a substituted or unsubstituted hydrocarbon ring, and n is a number from 10 to 1000.

In European patent application 237,953 has been disclosed a photosensitive member for electrophotography comprising a photosensitive layer on a conductive substrate, the photosensitive layer containing as a binder resin a modified polycarbonate resin having repeating structural units represented by the following general formulae (1) and (2):

(1)

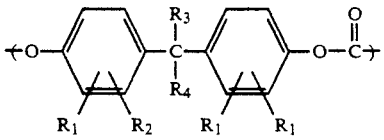

wherein $R_1$ and $R_2$ are selected from a hydrogen atom, an alkyl group having 1–3 carbon atoms and a halogen atom, at least one of $R_1$ and $R_2$ being an alkyl group, and $R_3$ and $R_4$ independently represent an alkyl group having 1–3 carbon atoms or a hydrogen atom, and (2)

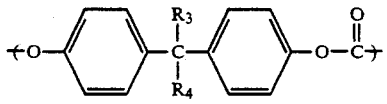

wherein $R_3$ and $R_4$ are the same as defined in the above formula (1). The ratio of the structural unit (1) to (2) is at least 20:80. This photosensitive member is according to the disclosers highly resistant to mechanical wear without deterioration of sensitivity and chargeability.

However, particularly one plasticized by the presence of low molecular weight charge carrier transport molecules polycarbonates exhibit inadequate mechanical toughness and thus poor abrasion resistance in addition to their well-known susceptibility to crazing in contact with solvents used in liquid toner development.

In Japanese Patent Application 62-267,747 has been disclosed the use of polyester carbonates with following structural units:

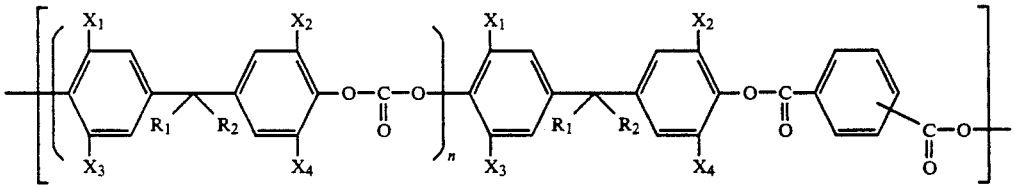

where n is an integer from 1 to 4, $R_1$ and $R_2$ are independently hydrogen, alkyl or an aromatic group and $X_1$, $X_2$, $X_3$ and $X_4$ are independently hydrogen, a halogen atom or an alkyl group and weight averaged molecular weights between 10,000 and 100,000 as binders in photoconductive layers, according to the disclosers, satisfactory abrasion resistance and excellent layer adhesion and when used as protective layers exhibit, according to the disclosers, solvent resistance and very good mechanical properties.

Although photoconductors utilizing polyester carbonates as binders in the uppermost layer together with charge carrier transport materials exhibit improved abrasion resistance compared with the equivalent photoconductors with polycarbonates in the outermost layer, see the abrasion behaviour of the materials of comparative examples 3, 4, 5 and 6 compared with that of the materials of comparative examples 1 and 2, their photoconductive behaviour and their tendency to surface contamination by residual toner are unsatisfactory.

In DE-P 2 415 334 is disclosed the use of siloxane-ester block copolymers as binders in electrophotographic recording materials being effective as a separation or levelling agent and being compatible with the layer components, such a polymer having the structure:

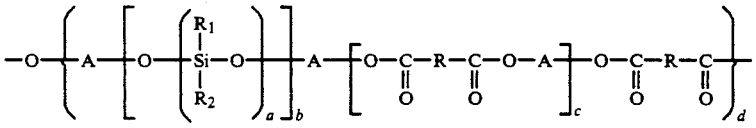

wherein R is 3–20 C alkylene; A is 2–20 C alkylene or arylene; $R_1$ and $R_2$ are 2–10 C alkyl or $R_2$ is alkyl, aralkyl or aryl; a is 10–200; b is 1–25; c is 5–20; and d is 2–1000. In said structure A represents preferably a phenylene or a bisphenylene with the following formula:

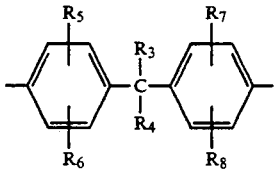

wherein $R_3$ and $R_4$ are a hydrogen atom or an alkyl group, a substituted alkyl group, an aryl group, an anthracenyl group, a substituted aryl group or jointly with bonded carbon atoms form a monocyclic, dicyclic or heterocyclic group. $R_5$, $R_6$, $R_7$ and $R_8$ are independently a hydrogen or halogen atom or an alkyl group, substituted alkyl group, aryl group or substituted aryl group.

It is an object of the present invention to provide a photoconductive recording material whose recording surface exhibits reduced surface contamination with non-transferred toner.

It is a further object of the present invention to provide a photoconductive recording material having a toner contacting surface whose frictional coefficient is very low.

Further objects of the present invention are to provide a photoconductive recording material having a good abrasion resistance and high photosensitivity.

Other objects and advantages of the present invention will appear from the further description and examples.

In accordance with the present invention a photoconductive recording material is provided which incorporates in an outermost layer one or more siloxane-copolymers including at least one polysiloxane block that is copolymerized with aromatic ester units or with aromatic carbonate units and aromatic ester units, wherein the polysiloxane block(s) consist(s) of 5 to 200 chemically bonded diorgano siloxy units in which the organic substituents are selected from the group consisting of an alkyl, an aralkyl, an alkaryl and an aryl group, and said block(s) is (are) present in an amount by weight in the range of 0.3% to 80% with respect to the total weight of said copolymer, and wherein the aromatic carbonate part of said copolymer is present in the range of 0 to 04.7% by weight of said copolymer, and in said part the aromatic carbonate units correspond to the following general formula (I):

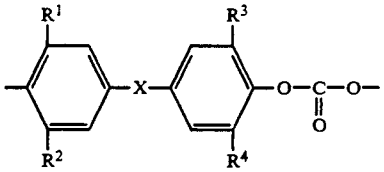

(I)

in which:

X represents S, $SO_2$,

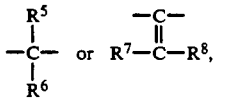

each of $R^1$, $R^2$, $R^3$, $R^4$, $R^7$ and $R^8$ (same or different) represents hydrogen, halogen, an alkyl group or an aryl group, and each of $R^5$ and $R^6$ (same or different) represents hydrogen, an alkyl group, an aryl group or together represent the necessary atoms to close a cycloaliphatic ring, e.g. a cyclohexane ring, and wherein the aromatic ester unit part of said copolymer is present in said copolymer in the range of 5 to 99.7% by weight and consists of a type of units within the scope of one of following structural formula (II) or (III) or consists of a mixture of both types of said units:

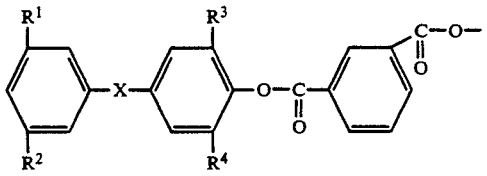

(II)

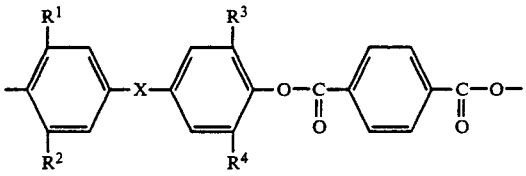

(III)

in which:

X, $R_1$, $R^2$, $R^3$ and $R^4$ have the same meaning as described above.

In said siloxane-copolymer blocks of polysiloxane (A), optionally present aromatic polycarbonate units (B) and/or aromatic polyester units (C) are normally present in a random order but they may be present in alternating, e.g. [-A-B-C-] order.

Siloxane-copolymers that are preferred for use according to the present invention contain aromatic polyester groups derived from either isophthalic or terephthalic acid or both isophthalic and terephthalic acids.

In preferred siloxane-copolymers for use according to the present invention the siloxane blocks are present in an amount by weight in the range 0.5% to 40% with respect to the total weight of said copolymer, the aromatic carbonate part is present in the range of 0 to 79.5% by weight of said copolymer, and the aromatic ester part is present in the range of 20 to 99.5% by weight of said copolymer.

The number averaged molecular weight of siloxane-copolymers for use according to the present invention is preferably in the range of 10,000 to 400,000.

The copolymers used according to the present invention may be prepared analogously to processes disclosed in U.S. Pat. No. 3,189,662, DE P 1 595 79, DE-P 2 411 123, DE-P 2 411 363, EP 216,106, DE-OS 3 506 472, EP 146,827, U.S. Pat. No. 3,701,815, DE-OS 2 640 241 and DE patent application P 3838106.0.

The siloxane-copolymer may be used wither in a protective layer, in a charge transport or in a charge generation layer or in a layer containing both charge generating and charge transporting substances when such layer forms the outermost layer of a photoconductive recording material.

A photoconductive recording material according to the present invention has in the binder or binder mixture content of the outermost layer sufficient of said copolymer to have therein a siloxane part in a concentration in the range of 0.1 to 30% by weight, preferably in the range of 0.5 to 20% by weight.

Photoconductive recording materials according to the present invention containing said siloxane-copolymer exhibit improved photosensitivity and reduced residual potentials in addition to improved abrasion resistance, a reduced tendency to surface contamination with toner and a reduced surface frictional coefficient.

According to one embodiment said outermost layer serves as protective layer for a photoconductive recording material and consists of at least one or more of said siloxane-copolymers or contains said copolymer(s) in combination with at least one other polymer.

According to another embodiment a photoconductive recording material according to the present invention contains in an outermost layer at least one or more of said siloxane-copolymers as binding agent for a charge generating and/or charge transporting substance.

In a particular embodiment a photoconductive recording material according to the present invention comprises an electrically conductive substrate with a charge carrier generating layer and a charge transfer layer superposed on said substrate, wherein said siloxane-copolymer is present in the outermost layer of said material.

The siloxane-copolymer(s) applied according to the present invention may be used in combination with at least one other polymer serving as binding agent, e.g. in combination with acrylate and methacrylate resins, copolyesters of a diol, e.g. glycol, with isophthalic and/or terephthalic acid, polyvinyl acetals, polyurethanes, polyester-urethanes, aromatic polycarbonates, and/or polyestercarbonates, wherein a preferred combination contains at least 2% by weight of said siloxane-copolymer to the total binder content.

A polyester resin particularly suited for used in combination with said polysiloxane-block copolymer is DYNAPOL 206 (registered trade mark of Dynamit Nobel for a copolyester of terephthalic acid and isophthalic acid with ethylene glycol and neopentyl glycol, the molar ratio of tere- to isophthalic acid being 3/2). Said polyester resin improves the adherence to aluminium that may form a conductive coating on the support of the recording material.

Aromatic polycarbonates suitable for use in the active layers of the photoconductive recording material according to the present invention can be prepared by methods such as those described by D. Freitag, U. Grigo, P. R. Müller and W. Nouvertné in the Encyclopedia of Polymer Science and Engineering, 2nd ed., Vol. III pages 648–718, (1988) published by Wiley and Sons Inc., and have one or more repeating units within the scope of following general formula:

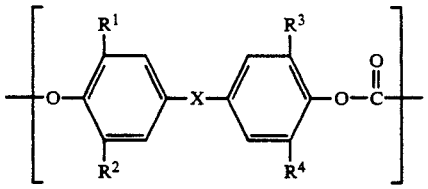

wherein:

X, $R^1$, $R^2$, $R^3$ and $R^4$ have the same meaning as described in general formula (I) above.

Aromatic polycarbonates having a weight-averaged molecular weight in the range of 10,000 to 500,000 are preferred. Suitable polycarbonates having such a high molecular weight are sold under the registered trade mark MAKROLON of Bayer AG, W-Germany.

MAKROLON CD 2000 (registered trade mark) is a bisphenol A polycarbonate with molecular weight in the range of 12,000 to 25,000 wherein $R^1=R^2=R^3=R^4=H$, X is $R^5$-C-$R^6$ with $R^5=R^6=CH_3$.

MAKROLON 5700 (registered trade mark) is a bisphenol A polycarbonate with molecular weight in the range of 50,000 to 120,000 wherein $R^1=R^2=R^3=R^4=H$, X is $R^5$-C-$R^6$ with $R^5=R^6=CH_3$.

Bisphenol Z polycarbonate is an aromatic polycarbonate containing recurring units wherein $R^1=R^2=R^3=R^4=H$, X is $R^5$-C-$R^6$ and $R^5$ together with $R^6$ represents the necessary atoms to close a cyclohexane ring.

Polyester carbonates suitable for use in the active layers of the photoconductive recording material according to the present invention can be prepared by methods such as those described by D. Freitag, U. Grigo, P. R. Müller and W. Nouvertné in the Encyclopedia of Polymer Science and Engineering, 2nd ed., Vol. III pages 648–718, (1988) published by Wiley and Sons Inc., and have one or more repeating units according to the general formulae (I) and (II), (I) and (III) or (I), (II) and (III) as described hereinbefore with weight averaged molecular weights between 10,000 and 200,000 being preferred.

Suitable electronically inactive binder resins for use in an active layer which is not an outermost layer containing photoconductors are e.g. the above mentioned polycarbonates, polyesters and polyester carbonates but likewise cellulose esters, acrylate and methacrylate resins, e.g. cyanoacrylate resins, polyvinyl chloride, copolymers of vinyl chloride, e.g. copolyvinyl chloride/acetate and copolyvinyl chloride/maleic anhydride, polyester resins, e.g. copolyesters of isophthalic acid and terephthalic acid with glycol, aromatic polycarbonate resins or polyester carbonate resins.

Further useful binder resins for an active layer are silicone resins, polystyrene and copolymers of styrene and maleic anhydride and copolymers of butadiene and styrene.

Protective layers containing siloxane copolymers according to the present invention may contain fillers such as silica and have layer thicknesses of less than 5 μm, preferably less than 2 μm.

Charge transport layers in the photoconductors of the present invention have thicknesses in the range of 5 to 50 μm, preferably in range of 5 to 30 μm. If these layers contain low molecular weight charge transport molecules they will be present in concentrations of 30 to 70% by weight.

Photoconductive recording materials according to the present invention with a single active layer have e.g. a layer thickness in the range of 5 to 50 μm, preferably in the range of 5 to 30 μm. If said layers contain low molecular weight charge transport molecules they will be present in concentrations of 3 to 50% by weight. The charge generating pigments or dyes will be present in concentrations between 0.1 and 40% by weight.

The presence of one or more spectral sensitizing agents can have an advantageous effect on the charge transport. In that connection reference is made to the methine dyes and xanthene dyes described in U.S. Pat. No. 3,832,171. Preferably these dyes are used in an amount not substantially reducing the transparency in the visible light region (420–750 nm) of the charge transporting layer.

The charge transporting layer may contain compounds substituted with electron-acceptor groups forming an intermolecular charge transfer complex, i.e. donor-acceptor complex when an electron donor charge transport compound is present. Useful compounds having electron-accepting groups are nitrocellulose and aromatic nitro-compounds such as nitrated fluorenone-9 derivatives, nitrated 9-dicyanomethylene fluorenone derivatives, nitrated naphthalenes and nitrated naphthalic acid anhydrides or imide derivatives. The optimum concentration range of said derivatives is such that the molar donor/acceptor ratio is 10:1 to 1,000:1 and vice versa.

Compounds acting as stabilising agents against deterioration by ultra-violet radiation, so-called UV-stabilizers, may also be incorporated in said charge transport layer. Examples of UV-stabilizers are benztriazoles.

For controlling the viscosity and aiding deaeration of the coating compositions and controlling their optical clarity silicone oils may be added to the charge transport layer.

As charge generating compounds for use in a recording material according to the present invention any of the organic pigments belonging to one of the classes a) to n) mentioned hereinbefore may be used. Further examples of pigments useful for photogenerating positive charge carriers are disclosed in U.S. Pat. No. 4,365,014.

Inorganic substances suited for photogenerating positive charges in a recording material according to the present invention are e.g. amorphous selenium and selenium alloys e.g. selenium-tellurium, selenium-tellurium-arsenic and selenium-arsenic and inorganic photoconductive crystalline compounds such as cadmium sulphoselenide, cadmium selenide, cadmium sulphide and mixtures thereof as disclosed in U.S. Pat. No. 4,140,529.

Said photoconductive substances functioning as charge generating compounds may be applied to a support with or without a binding agent. For example, they are coated by vacuum-deposition without binder as described e.g. in U.S. Pat. No. 3,972,717 and 3,973,959. When dissolvable in an organic solvent the photoconductive substances may likewise be coated using a wet coating technique known in the art whereupon the solvent is evaporated to form a solid layer. When used in combination with a binding agent or agents at least the binding agent(s) should be soluble in the coating solution and the charge generating compound dissolved or dispersed therein. The binding agent(s) may be the same as the one(s) used in the charge transport layer which normally provided best adhering contact. In some cases it may be advantageous to use in one or both of said layers a plasticizing agent, e.g. halogenated paraffin, polybiphenyl chloride, dimethylnaphthalene or dibutyl phthalate.

The thickness of the charge generating layer is preferably not more than 10 μm, more preferably not more than 5 μm.

In the recording materials of the present invention an adhesive layer or barrier layer may be present between the charge generating layer and the support or the charge transport layer and the support. Useful for that purpose are e.g. a polyamide layer, nitrocellulose layer, hydrolysed silane layer, or aluminum oxide layer acting as blocking layer preventing positive or negative charge injection from the support side. The thickness of said barrier layer is preferably not more than 1 micron.

The conductive support may be made of any suitable conductive material. Typical conductors include aluminium, steel, brass and paper and resin materials incorporating or coated with conductivity enhancing substances, e.g. vacuum-deposited metal, dispersed carbon black, graphite and conductive monomeric salts or a conductive polymer, e.g. a polymer containing quaternized nitrogen atoms as in Calgon Conductive polymer 261 (trade mark of Calgon Corporation, Inc., Pittsburgh, Pa., U.S.A.) described in U.S. Pat. No. 3,832,171.

The support may be in the form of a foil, web or be part of a drum.

An electrophotographic recording process according to the present invention comprises the steps of:

(1) overall electrostatically charging, e.g. with corona-device, a charge transporting layer or charge generating layer in the case of a two layer recording material according to the present invention or the photoconductive layer of a monolayer recording material according to the present invention, and (2) image-wise photo-exposing said charge generating layer of said two layer recording material or the photoconductive layer of said monolayer recording material thereby obtaining a latent electrostatic image.

In the case of two layer recording materials, the photo-exposure of the charge generating layer proceeds preferably through the charge transporting layer, but may be direct if the charge generating layer is outermost or may proceed likewise through the conductive support if the latter is transparent enough to the exposure light. In the case of monolayer recording materials the photo-exposure preferably proceeds directly or may proceed through the conductive support.

The development of the latent electrostatic image commonly occurs with finely divided electrostatically attractable material, called toner particles that are attracted to coulomb force to the electrostatic charge pattern. The toner development is a dry or liquid toner development known to those skilled in the art.

In positive-positive development toner particles deposit on those areas of the charge carrying surface which are in positive-positive relation to the original image. In reversal development, toner particles migrate and deposit on the recording surface areas which are in negative-positive image value relation to the original. In the latter case the areas discharged by photo-exposure obtain by induction through a properly biased developing electrode a charge of opposite charge sign with respect to the charge sign of the toner particles so that the toner becomes deposited in the photo-exposed areas that were discharged in the imagewise exposure (ref. R. M. Schaffert "Electrophotography"—The Focal Press—London, New York, enlarged and revised edition 1975, p. 50–51 and T. P. MacLean "Electronic Imaging" Academic Press—London, 1979, p. 231).

According to a particular embodiment electrostatic charging, e.g. by corona, and the imagewise photo-exposure proceed simultaneously.

Residual charge after toner development may be dissipated before starting a next copying cycle by overall exposure and/or alternating current corona treatment.

Recording materials according to the present invention depending on the spectral sensitivity of the charge generating layer may be used in combination with all kinds of photon-radiation, e.g. light of the visible spectrum, infra-red light, near ultra-violet light and likewise X-rays when electron-positive hole pairs can be formed by said radiation in the charge generating layer. Thus, they can be used in combination with incandescent lamps, fluorescent lamps, laser light sources or light emitting diodes by proper choice of the spectral sensitivity of the charge generating substance or mixtures thereof.

The toner image obtained may be fixed onto the recording material or may be transferred to a receptor material to form thereon after fixing the final visible image.

A recording material according to the present invention showing a particularly low fatigue effect can be used in recording apparatus operating with rapidly following copying cycles including the sequential steps of overall charging, imagewise exposing, toner development and toner transfer to a receptor element.

The wear characteristics of the recording materials of the following examples have been assessed on the basis of abrasion experiments with a TELEDYNE TABER Model 505 Dual Abrasion Tester (Teledyne Taber is a registered trade name) with a loading of 500 g and with CS-10F standardized abrasion test wheels. During these experiments the abraded material was continuously removed with a vacuum cleaner. The quantity of material removed after 500 rotations (200 rotations in cases in which the charge generation layer was outermost) was taken as a measure of the abrasion resistance of the recording material.

The tendency to surface contamination and the frictional coefficient of the recording materials of the following examples have been assessed on the basis of contact angle measurements with "pro analysis" quality glycerol: the higher the contact angle, the lower the tendency to surface contamination and the lower the surface friction coefficient.

The evaluations of electrophotographic properties determined on the recording materials of the following examples relate to the performance of the recording materials in an electrophotographic process with a reusable photoreceptor. The measurements of the performance characteristics were carried out as follows:

The photoconductive recording sheet material was mounted with is conductive backing on an aluminium drum which was earthed and rotated at a circumferential speed of 10 cm/s. The recording material was sequentially charged with a negative corona at a voltage of −4.6 kV operating with a corona current of about 1 μA per cm of corona wire. Subsequently the recording material was exposed (simulating image-wise exposure) with monochromatic light obtained from a monochromator positioned at the circumference of the drum at an angle of 45° with respect to the corona source [see Tables 1 to 4 for the wavelength (λ) in nm of the applied light and the light dose (I.t) used expressed in mJ/m2]. The photo-exposure lasted 200 ms. Thereafter, the exposed recording material passed an electrometer probe positioned at an angle of 180° with respect to the corona source.

After effecting an overall post-exposure with a halogen lamp producing 27,000 mJ/m2 positioned at an angle of 270° with respect to the corona source a new copying cycle was started.

Each measurement relates to 100 copying cycles in which 10 cycles without monochromatic light exposure are alternated with 5 cycles with monochromatic light exposure.

The charging level (CL) is taken as the average charging level over the 90th to 100th cycle, the residual potential (RP) as the redisual potential over the 85th to 90th cycle. The % discharge is expressed as: $(CL-RP)/CL\times 100$, and the fatigue (F) as the difference in residual potential in volts between RP and the average residual potential over the 10th to 15th cycle.

For a given corona voltage, corona current, separating distance of the corona wires to recording surface and drum circumferential speed the charging level CL is only dependent upon the thickness of the charge transport layer and its specific resistivity. In practice CL expressed in volts [V] should be preferably $>30$ d, where d is the thickness in μm of the charge transport layer (CTL).

Under the applied exposure conditions, simulating practical copying conditions, and by using a charge transport layer in conjunction with a charge generating layer on the basis of X-phthalocyanine as the charge generating pigment the % discharge (% DC) should he at least 35% and preferably at least 50%. The fatigue f should preferably not exceed 30 V either negative or positive to maintain a uniform image quality over a large number of copying cycles.

The following examples further illustrate the present invention.

All ratios and percentages mentioned in the examples are by weight unless otherwise stated.

EXAMPLES 1 to 3 and COMPARATIVE EXAMPLES 1 to 6

In the production of a composite layer electrophotographic recording material a 100 μm thick polyester film pre-coated with a vacuum-deposited conductive layer of aluminium was doctor-blade coated with a dispersion of charge generating pigment to a thickness of 0.6 μm with a doctor-blade coater.

Said dispersion was prepared by mixing 1 g of metal-free X-phthalocyanine, 0.1 g of a polyester adhesion-promoting additive DYNAPOL L206 (registered trade mark), 0.9 g of aromatic polycarbonate MAKROLON CD2000 (registered trade mark) [Polymer 4] and 23 g of dichloromethane for 20 minutes in a pearl mill. Sad dispersion was diluted with 8 g of dichloromethane to the required coating viscosity.

The applied layer was dried for 15 minutes at 80° C. and then overcoated using a doctor-blade coater with a filtered solution of charge transporting material and binder consisting of 1.5 g of tris(p-tolyl)amine, 2.25 g of the polymer for the appropriate example or comparative example (see Table 1) and 23.03 g of dichloromethane to a thickness also given in Table 1. This layer was then dried at 50° C. for 16 hours.

The chemical composition and physical characteristics of the copolymers and of the therewith obtained photoconductive recording materials are given in Table 1 together with those for 6 comparative examples using polycarbonates or polyester-carbonates as binders in the charge transporting layer.

TABLE 1

| | Polymer no. | Block copolymer composition: siloxane wt % | BPA "carb" wt % | BPA[xx] ester wt % | Siloxane blocks: subst. | no. of units in block | weight averaged molecular weight $M_w$ | number averaged molecular weight $M_n$ |
|---|---|---|---|---|---|---|---|---|
| Example no. | | | | | | | | |
| 1 | 1 | 5 | 47.5 | 47.5 | $CH_3;CH_3$ | 75 | 25,398** | 12,854** |
| 2 | 2 | 5 | 19 | 76 | $CH_3;CH_3$ | 75 | 179,719** | 30,355** |
| 3 | 3 | 5 | — | 95 | $CH_3;CH_3$ | 65 | | |
| Comparative example no. | | | | | | | | |
| 1 | 4* | — | 100 | — | — | — | | |
| 2 | 5+x | — | 100 | — | — | — | | |
| 3 | 6 | — | 50 | 50 | — | — | 28,895** | 13,444** |
| 4 | 7 | — | 20 | 80 | — | — | 29,458** | 14,629** |
| 5 | 8x | — | 20 | 80 | — | — | 214,734** | 33,168** |
| 6 | 9 | — | 20 | 80 | — | — | 206,879** | 34,211** |

*Makrolon CD2000 (registered trademark).
+Makrolon 5700 (registered trademark).
xhigh molecular weight, i.e. $M_w > 100{,}000$.
xx50/50 isophthalate/terephthalate.
**determined by Gel permeation chromatograph using UV detection and calibration with bisphenol A-polycarbonate samples.
BPA is 2,2-bis-(4-hydroxyphenyl)-propane = Bisphenol A.
"carb" is carbonate.

| | ηrel | Abrasion over 500 rotations [mg] | Contact angle (°) | $d_{CTL}$ [μm] | $I_{780}t$ = 10.3 mJ/m2: CL [V] | RP [V] | % discharge | F [V] | RP for $I_{780}t$ = 208 mJ/m2 [V] |
|---|---|---|---|---|---|---|---|---|---|
| Example no. | | | | | | | | | |
| 1 | 1.245 | 6.5 | 91.2 | 17.4 | −500 | −176 | 64.8 | +31 | −28 |
| 2 | 2.23 | 8.2 | 81.1 | 11.4 | −667 | −166 | 75.1 | +32 | −19 |
| 3 | 1.325 | 6.8 | 90.2 | 15.4 | −802 | −234 | 70.8 | | −47 |
| Comparative example no. | | | | | | | | | |
| 1 | — | 8.6 | 60.3 | 17.4 | −809 | −232 | 71.3 | +17 | −29 |
| 2 | — | 5.5 | 51.3 | 12.4 | −476 | −162 | 66.0 | +23 | −27 |
| 3 | 1.30 | 5.2 | 71.0 | 15.4 | −655 | −242 | 63.0 | +21 | −37 |
| 4 | 1.305 | 5.8 | 53.7 | 18.4 | −645 | −209 | 67.6 | +30 | −32 |
| 5 | 2.22 | 4.4 | 52.5 | 11.4 | −484 | −155 | 68.0 | +26 | −24 |
| 6 | 2.29 | 3.5 | 64.9 | 11.4 | −836 | −298 | 64.4 | +20 | −76 |

ηrel is the relative viscosity determined for 5 g of polymer per liter of $CH_2Cl_2$ at 25° C., being a measure of the molecular weight of the polymer and increasing with increasing molecular weight.
$d_{CTL}$ represents the thickness of the charge transporting layer.

EXAMPLE 4

Example 4 was identical to Example 1 except that the binder in the charge transporting layer, Polymer 10, has a relative viscosity measured as defined above of 2.294 instead of 1.245.

The characteristics of this photoconductive recording material were determined as described above and the abrasion characteristics, contact angle and photoconductive behaviour are given below together with these for Example 1 :

| | Example 1 | Example 4 |
|---|---|---|
| Polymer no. | 1 | 10 |
| ηrel | 1.245 | 2.294 |
| Abrasion over 500 rotations [mg] | 6.5 | 5.6 |
| Contact angle (°) | 91.2 | 88.9 |
| $d_{CTL}$ [μm] | 17.4 | 13.4 |
| For $I_{780}$ t = 10.3 mJ/m2: | | |
| CL [V] | −500 | −801 |
| RP [V] | −176 | −380 |
| % discharge | 64.8 | 52.6 |
| F [V] | +31 | |
| RP for $I_{780}$ t = 208 mJ/m2 [V] | −28 | −52 |

EXAMPLES 5 and 6

Examples 5 and 6 were prepared using the same charge generating layer as for Examples 1 to 3. The charge generating layer was overcoated using a doctor-blade coater with a filtered solution of charge transport material and binder consisting of 1.6 g of tris (p-tolyl)amine, 2.4 g of the polymer for the appropriate example (see Table 2) and 23.03 g of dichloromethane to a thickness also given in Table 2. This layer was then dried at 50° C. for 16 hours.

The characteristics of the thus obtained photoconductive recording materials were determined as described above and the abrasion characteristics, contact angles and photoconductive behaviour are given together with those of Example 4 in Table 2.

TABLE 2

| Example no. | Polymer no. | Block copolymer composition: siloxane wt % | BPA "carb" wt % | BPA[xx] ester wt % | Siloxane blocks: subst. | no. of units in block | ηrel++ | Abrasion over 500 rotations [mg] | Contact angle (°) | $d_{CTL}$ [μm] | $I_{780t}$ = 10.3 mJ/m2: CL [V] | RP [V] | % discharge | RP for $I_{780t}$ = 208 mJ/m2 [V] |
|---|---|---|---|---|---|---|---|---|---|---|---|---|---|---|
| 4 | 10 | 5 | 47.5 | 47.5 | $CH_3;CH_3$ | 65 | 2.294 | 5.6 | 88.9 | 13.4 | −801 | −380 | 52.6 | −52 |
| 5 | 11 | 10 | 45 | 45 | $CH_3;CH_3$ | 65 | 2.569 | 7.0 | 88.6 | 12.4 | −711 | −294 | 58.6 | −24 |
| 6 | 12 | 30 | 35 | 35 | $CH_3;CH_3$ | 65 | 2.040 | 4.4 | 88.3 | 14.4 | −709 | −299 | 57.8 | −19 |

[xx]50/50 isophthalate/terephthalate
BPA is 2,2-bis-(4-hydroxyphenyl)-propane = Bisphenol A.
"carb" is carbonate.
++determined for 5 g/l $CH_2Cl_2$ at 25° C.

EXAMPLES 7 to 10 and COMPARATIVE EXAMPLE 7

Examples 7 to 10 and comparative example 7 were prepared using the same charge generating layer as for Examples 1 to 3 except that polymer 5 was used instead of polymer 4. The charge generating layers were overcoated using a doctor-blade coater with a filtered solution of charge transport material and hinder consisting of 2 g of 1,2-his(1,2-dihydro-2,2,4-trimethyl-quinolin-1-yl) ethane, 2 g of a mixture of polymers 1 and 5 (see Table 1) in the weight ratios given in table 3 and 26.6 g of dichloromethane to thicknesses also given in table 3. These layers were then dried at 50° C. for 16 hours.

The characteristics of the thus obtained photoconductive recording materials were determined as described above and the abrasion characteristics, contact angles and photoconductive behaviour are given in Table 3.

TABLE 3

| | $d_{CTL}$ [μm] | Binder composition in charge transport layer: Polymer 1 conc. [wt %] | Polymer 5 conc. [wt %] | Abrasion over 500 rotations [mg] | Contact angle (°) | $I_{650t}$ = 13.2 mJ/m2: CL [V] | RP [V] | % discharge | F [V] |
|---|---|---|---|---|---|---|---|---|---|
| Example no. | | | | | | | | | |
| 7 | 17.4 | 100 | 0 | 11.8 | 98.0 | −787 | −392 | 50.2 | −13 |
| 8 | 13.4 | 40 | 60 | 6.3 | 93.1 | −530 | −225 | 57.5 | +16 |
| 9 | 12.4 | 20 | 80 | 6.0 | 97.3 | −500 | −212 | 57.6 | +14 |
| 10 | 11.4 | 10 | 90 | 5.3 | 90.6 | −499 | −215 | 56.9 | +12 |
| Comparative example | | | | | | | | | |
| 7 | 15.4 | 0 | 100 | 5.4 | 64.0 | −506 | −214 | 57.7 | +8 |

EXAMPLES 11 and 12 and COMPARATIVE EXAMPLES 8 and 10

Examples 11 and 12 and Comparative Examples 8 to 10 were produced by first doctor-blade coating a 100 um thick polyester film precoated with a vacuum-deposited conductive layer of aluminium with a 1% solution of γ-aminopropyltriethoxy silane in aqueous methanol. After solvent evaporation and curing at 100° C. for 30 minutes, the thus obtained adhesion/blocking layer was doctor-blade coated with a filtered solution of charge transporting material and binder consisting of 3 g of 1,2-bis-(1,2-dihydro-2,2,4-trimethyl-quinolin-1-yl) ethane, 3 g of polymer 5 and 44 g of dichloromethane to a thickness of about 13 μm.

After drying for 15 minutes at 50° C., this layer was coated with a dispersion of charge generating pigment to the thicknesses given in Table 4. Said dispersion was prepared by mixing 1.33 g of metal-free X-phthalocyanine, 2.66 g of 1,2-bis(1,2-dihydro-2,2,4-trimethyl-quinolin-1-yl) ethane, 2.66 g of the polymer or polymer mixture for the appropriate example or comparative example in Table 4 and 40.9 g of dichloromethane for 15 minutes in a pearl mill. Subsequently the dispersion was diluted with 7.9 g of dichloromethane to the required coating viscosity. The layer was then dried at 50° C. for 16 hours.

The characteristics of the thus obtained photoconductive recording materials were determined as described above and the abrasion characteristics (abrasion after 200 TABER abrader rotations due to the thinner outermost layer), contact angles and photoconductive behaviour are given in Table 4.

TABLE 4

| | $d_{CGL}$ [μm] | Binder composition in charge generation layer | Abrasion over 200 rotations [mg] | Contact angle (°) | $I_{650t}$ = 13.2 mJ/m2: CL [V] | RP [V] | % discharge | F [V] | RP for $I_{650t}$ = 264 mJ/m2 [V] |
|---|---|---|---|---|---|---|---|---|---|
| Example no. | | | | | | | | | |
| 11 | 6 | Polymer 1 | 7.5 | 88.8 | +868 | +209 | 75.9 | −1 | +49 |
| 12 | 5 | Polymer 2 | 6.5 | 96.5 | +838 | +237 | 71.7 | −3 | +28 |
| Comparative example no. | | | | | | | | | |
| 8 | 8 | Polymer 5 | 5.3 | 69.6 | +804 | +200 | 75.1 | +3 | +41 |
| 9 | 8 | Polymer 7 | 7.4 | 67.7 | +822 | +193 | 76.5 | +13 | +59 |

TABLE 4-continued

| | $d_{CGL}$ [μm] | Binder composition in charge generation layer | Abrasion over 200 rotations [mg] | Contact angle (°) | $I_{650}t$ = 13.2 mJ/m2 CL [V] | RP [V] | % discharge | F [V] | RP for $I_{650}t$ = 264 mJ/m2 [V] |
|---|---|---|---|---|---|---|---|---|---|
| 10 | 5 | Polymer 8 | 4.4 | 63.8 | +856 | +205 | 76.1 | −29 | +48 |

EXAMPLES 13 and 15 and COMPARATIVE EXAMPLE 11

Commercial $As_2Se_3$ coated electrophotographic drums were coated using a dip-coating apparatus such as that described in the unpublished EP- Application no. 90201295.4 with a dichloromethane solution of polymer forming a thin polymer layer. Details about the polymers coated, the polymer concentration (in percent by weight) and the relative velocity (RV) between the drum and the vessel holding the polymer solution as the drum emerged from the coating solution for the Examples 13 to 15 and Comparative Example II are given in Table 5. Each of the coated layers was dried at 80 ° C. for about 30 minutes.

The polymer coated drums were then mounted in a GEVAfAX X35 (registered trade mark) copier and the toner transfer from the photoconductor drum to paper was monitored as a function of coating for a particular toner, which exhibited incomplete toner transfer from uncoated $As_2Se_3$ photoconductor drums. The results are summarized in Table 5 and show that $As_2Se_3$ photoconductor drums coated with copolymers consisting of polysiloxane blocks, aromatic ester units and aromatic carbonate units as defined in the present Examples 13 to 15 (Polymers 1 and 2) exhibit satisfactory transfer of toner to paper, whereas uncoated $As_2Se_3$ photoconductor drums and $As_2Se_3$ photoconductor drums coated with bisphenol A polycarbonate (Polymer 13) exhibit poor transfer of toner to paper.

TABLE 5

| | Polymer No. | Polymer layer casting conditions: Polymer conc. | RV mm/s | Toner transfer efficiency |
|---|---|---|---|---|
| Example No. | | | | |
| 13 | 1 | 3 | 2.5 | satisfactory |
| 14 | 1 | 3 | 2.0 | satisfactory |
| 15 | 2 | 2 | 1.25 | satisfactory |
| Comparative Example | | | | |
| 11 | 13* | 2 | 5.0 | poor |

*Bisphenol A-polycarbonate MAKROLON 3208 (registered trade mark).

We claim:

1. A photoconductive recording material which incorporates in an outermost layer a siloxane-copolymer including at least one polysiloxane block that is copolymerized with aromatic ester units or with aromatic carbonate units and aromatic ester units, wherein the polysiloxane block(s) consist(s) of 5 to 200 chemically bonded diorgano siloxy units in which the organic substituents are selected from the group consisting of an alkyl, an aralkyl, an alkaryl and an aryl group, and said block(s) is (are) present in an amount by weight in the range of 0.3% to 80% with respect to the total weight of said copolymer, and wherein the aromatic carbonate part of said copolymer is present in the range of 0 to 94.7% by weight of said copolymer, and in said part the aromatic carbonate units correspond to the following general formula (I) :

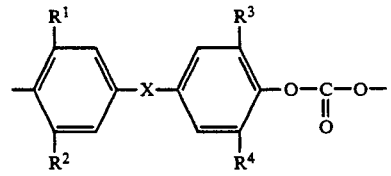

(I)

in which:

X represents S, $SO_2$,

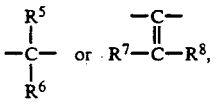

each of $R^1$, $R^2$, $R^3$, $R^4$, $R^7$ and $R^8$ (same or different) represents hydrogen, halogen, an alkyl group or an aryl group, and each of $R^5$ and $R^6$ (same or different) represents hydrogen, an alkyl group, an aryl group or together represent the necessary atoms to close a cycloaliphatic ring, and wherein the aromatic ester unit part of said copolymer is present in said copolymer in the range of 5 to 99.7% by weight and consists of a type of units within the scope of one of following structural formula (II) or (111) or consists of a mixture of both types of said units :

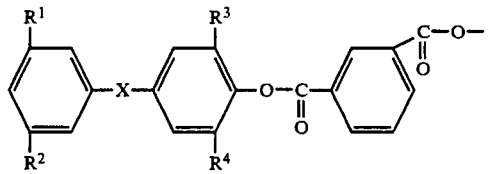

(II)

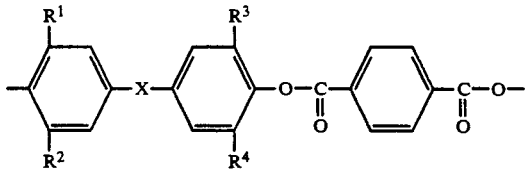

(III)

in which:

X, $R^1$, $R^2$, $R^3$ and $R^4$ have the same meaning as described above.

2. A photoconductive recording material according to claim 1, wherein in said siloxane-copolymer the siloxane blocks are present in an amount by weight in the range 0.5% to 40% with respect to the total weight of said copolymer, the aromatic carbonate part is present in the range of 0 to 7.5% by weight of said copolymer, and the aromatic ester part is present in the range of 20 to 99.5% by weight of said copolymer.

3. A photoconductive recording material according to claim 1, wherein said outermost layer serves as protective layer and consists of one or more of said siloxane-copolymers.

4. A photoconductive recording material according to claim 1, wherein in said outermost layer at least one of said siloxane-copolymers are present as binding agent for a charge generating and/or charge transporting substance.

5. A photoconductive recording material according to claim 1, wherein said outermost layer serving as protective layer contains said siloxane-copolymer in combination with at least one other binding agent polymer.

6. A photoconductive recording material according to claim 4, wherein in said outermost layer said siloxane-copolymer is present in combination with at least one other binding agent polymer.

7. A photoconductive recording material according to claim 5, wherein said siloxane-copolymer is present in combination with at least one other polymer selected from the group consisting of an acrylate and methacrylate resin, copolyester of a diol with isophthalic and/or terephthalic acid, polyvinyl acetal, polyurethane, polyester-urethane, aromatic polycarbonate, and polyestercarbonate, wherein the combination contains at least 2% by weight of said siloxane-copolymer in the total binder content.

8. A photoconductive recording material according to claim 1, wherein the siloxane concentration in the binder or binder mixture content of the outermost layer is in the range of 0.1 to 30% by weight.

9. A photoconductive recording material according to claim 1, wherein the siloxane concentration in the binder or binder mixture content of the outermost layer is in the range of 0.5 to 20% by weight.

10. A photoconductive recording material according to claim 1, wherein the number averaged molecular weight of siloxane-copolymer is in the range cf 10,000 to 400,000.

11. A photoconductive recording material according to claim 1, wherein in said siloxane-copolymer the aromatic polyester groups are derived from either isophthalic or terephthalic acid or both isophthalic and terephthalic acid.

12. A photoconductive recording material according to claim 1, wherein said recording material comprises an electrically conductive substrate with a charge carrier generating layer and a charge transfer layer superposed on said substrate, wherein said siloxane-copolymer is present in the outermost layer of said material.

13. A photoconductive recording material according to claim 1, wherein said recording material comprises as a charge generating substance metal-free X-phthalocyanine or 4,10-dibromo anthanthrone, and as a charge transporting substance tris(p-tolyl)amine or 1,2-his(1,2-dihydro-2,2,4-trimethyl-quinolin-1-yl) ethane.

* * * * *